US005697229A

United States Patent [19]

Agrawal et al.

[11] Patent Number: 5,697,229

[45] Date of Patent: Dec. 16, 1997

[54] PROCESS TO PRODUCE NITROGEN USING A DOUBLE COLUMN PLUS AN AUXILIARY LOW PRESSURE SEPARATION ZONE

[75] Inventors: Rakesh Agrawal, Emmaus; Zbigniew T. Fidkowski, Macungie, both of Pa.

[73] Assignee: Air Products and Chemicals, Inc., Allentown, Pa.

[21] Appl. No.: 693,714

[22] Filed: Aug. 7, 1996

[51] Int. Cl.[6] ..... F25J 1/00

[52] U.S. Cl. ..... 62/643; 62/617; 62/615; 62/651

[58] Field of Search ..... 62/643, 615, 617, 62/651

[56] References Cited

U.S. PATENT DOCUMENTS

| | | | |
|---|---|---|---|
| 4,222,756 | 9/1980 | Thorogood | 62/13 |
| 4,439,220 | 3/1984 | Olszewski et al. | 62/31 |
| 4,448,595 | 5/1984 | Cheung | 62/31 |
| 4,453,957 | 6/1984 | Pahade et al. | 62/25 |
| 4,594,085 | 6/1986 | Cheung | 62/25 |
| 4,604,117 | 8/1986 | Cheung | 62/25 |
| 4,617,036 | 10/1986 | Suchedo et al. | 62/11 |
| 4,662,916 | 5/1987 | Agrawal et al. | 62/13 |
| 4,927,441 | 5/1990 | Agrawal | 62/28 |
| 4,966,002 | 10/1990 | Parker et al. | 62/31 |
| 5,006,139 | 4/1991 | Agrawal et al. | 62/24 |
| 5,037,462 | 8/1991 | Schweigert | 62/24 |
| 5,069,699 | 12/1991 | Agrawal | 62/24 |
| 5,098,457 | 3/1992 | Cheung et al. | 62/24 |
| 5,129,932 | 7/1992 | Agrawal et al. | 62/22 |
| 5,231,837 | 8/1993 | Ha | 62/24 |
| 5,385,024 | 1/1995 | Roberts et al. | 62/25 |
| 5,402,647 | 4/1995 | Bonaquist et al. | 62/24 |

FOREIGN PATENT DOCUMENTS 1215377 12/1970 Germany .

*Primary Examiner*—Ronald C. Capossela
*Assistant Examiner*—Pamela A. O'Connor
*Attorney, Agent, or Firm*—Robert J. Wolff

[57] ABSTRACT

A process is set forth for the cryogenic distillation of an air feed to produce nitrogen, particularly high pressure nitrogen of various purity, varying from low purity (up to 98% nitrogen) to ultra-high purity (less than 1 part per billion of oxygen). The nitrogen may be produced at two different pressures and two different purities. The process uses an auxiliary low pressure separation zone in addition to the conventional high pressure column and low pressure column. The auxiliary low pressure separation zone, which is operated at the same pressure as the low pressure column and which is heat integrated with the top of the high pressure column by means of its bottom reboiler/condenser, pretreats the crude liquid oxygen from the bottom of the high pressure column.

20 Claims, 12 Drawing Sheets

PROCESS TO PRODUCE NITROGEN USING A DOUBLE COLUMN PLUS AN AUXILIARY LOW PRESSURE SEPARATION ZONE

TECHNICAL FIELD OF THE INVENTION

The present invention relates to a process for the cryogenic distillation of an air feed. As used herein, the term "air feed" generally means atmospheric air but also includes any gas mixture containing at least oxygen and nitrogen.

BACKGROUND OF THE INVENTION

The target market of the present invention is high pressure nitrogen of various purity, varying from low purity (up to 98% nitrogen) to ultra-high purity (less than 1 part per billion of oxygen) such as the nitrogen which is used in various branches of the chemical and electronic industry. Some applications may require delivery of nitrogen at two different pressures and two different purities. In some other processes, all the nitrogen product may be required at high purity and a high pressure. It is an objective of the present invention to design an efficient cryogenic cycle that can be easily adapted to meet all of these needs.

There are several processes known in the art of the production of nitrogen. The processes can be classified according to the number of distillation columns as single column cycles, single column with pre-fractionators or post-fractionators, double column cycles and cycles containing more than two distillation columns.

A classic single column nitrogen cycle is taught in U.S. Pat. No. 4,222,756. Vapor air is fed to the bottom of a rectifier, where it is separated into overhead vapor nitrogen and a bottom liquid, which is let down in pressure and boiled at the top of the column providing necessary reflux by indirect heat exchange with overhead vapor. The oxygen-enriched vapor from the top reboiler/condenser is discarded as a waste stream.

An advantage of a single column nitrogen generator is its simplicity and low capital cost. A big disadvantage of this cycle is limited recovery of nitrogen. Various other types of single column nitrogen generators were proposed to increase nitrogen recovery. In U.S. Pat. No. 4,594,085, an auxiliary reboiler was employed at the bottom of the column to vaporize a portion of the bottom liquid against air, forming additional liquid air feed to the column. A similar cycle enriched only with an air compander is taught in U.S. Pat. No. 5,037,462. A single column cycle with two reboilers is taught in U.S. Pat. No. 4,662,916. Yet another single column cycle, where a portion of the oxygen-enriched waste stream is compressed and recycled back to the column to further increase nitrogen recovery, is described in U.S. Pat. No. 4,966,002. Similarly, in U.S. Pat. No. 5,385,024 a portion of the oxygen-enriched waste stream is cold companded and recycled back to the column with feed air.

Nitrogen recovery in a single column system is considerably improved by addition of a second distillation unit. This unit can be a full distillation column or a small pre/post-fractionator built as a flash device or a small column containing just a few stages. A cycle consisting of a single column with a pre-fractionator, where a portion of a feed air is separated to form new feeds to the main column is taught in U.S. Pat. No. 4,604,117. In U.S. Pat. No. 4,927,441 a nitrogen generation cycle is taught with a post-fractionator mounted on the top of the rectifier, where oxygen-enriched bottom liquid is separated into even more oxygen-enriched fluid and a vapor stream with a composition similar to air. This synthetic air stream is recycled to the rectifier, resulting in highly improved product recovery and cycle efficiency. Also, the use of two reboilers to vaporize oxygen-enriched fluid twice at different pressures improves the cycle efficiency even further.

Classic double column cycles for nitrogen production are taught in U.S. Pat. No. 4,222,756. The novel distillation configuration taught in this patent consists of the double column with an additional reboiler/condenser at the top to provide reflux to the lower pressure column by vaporizing the oxygen-enriched waste fluid. Refrigeration is created by expanding nitrogen gas from the high pressure column.

A similar distillation configuration (with different fluids expanded for refrigeration) is taught in GB Patent 1,215,377 and U.S. Pat. No. 4,453,957. In U.S. Pat. No. 4,617,036, a side reboiler/condenser is employed instead of the heat exchanger at the top on the low pressure column. A dual column cycle with intermediate reboiler in the low pressure column is taught in U.S. Pat. No. 5,006,139. A cycle for production of moderate pressure nitrogen and coproduction of oxygen and argon was described in U.S. Pat. No. 5,129,932.

The dual column high pressure nitrogen process taught in U.S. Pat. No. 4,439,220 can be viewed as two standard single column nitrogen generators in series (this configuration is also known as a split column cycle). U.S. Pat. No. 4,448,595 differs from a split column cycle in that the lower pressure column is additionally equipped with a reboiler. In U.S. Pat. No. 5,098,457, yet another variation of the split column cycle is shown where the nitrogen liquid product from the top of low pressure column is pumped back to the high pressure column, to increase recovery of the high pressure product.

A triple column cycle for nitrogen production is described in U.S. Pat. No. 5,069,699 where an extra high pressure distillation column is used for added nitrogen production in addition to a double column system with a dual reboiler. Another triple column system for producing large quantities of elevated pressure nitrogen is taught in U.S. Pat. No. 5,402,647. In this invention, the additional column operates at a pressure intermediate to that of higher and lower pressure columns.

U.S. Pat. No. 5,231,837 by Ha teaches an air separation cycle wherein the top of the high pressure column is heat integrated with both the bottom of the low pressure column and the bottom of an intermediate pressure column. The intermediate column processes the crude liquid oxygen from the bottom of the high pressure column into a condensed top liquid fraction and a bottom liquid fraction which are subsequently fed to the low pressure column.

All the prior art nitrogen cycles have the following disadvantage: recovery of high pressure nitrogen from the column system is limited and cannot be increased.

SUMMARY OF THE INVENTION

The present invention is a process for the cryogenic distillation of an air feed to produce nitrogen, particularly high pressure nitrogen of various purity, varying from low purity (up to 98% nitrogen) to ultra-high purity (less than 1 part per billion of oxygen). The nitrogen may be produced at two different pressures and two different purities. The process uses an auxiliary low pressure separation zone in addition to the conventional high pressure column and low pressure column. The auxiliary low pressure separation zone, which is operated at the same pressure as the low pressure column and which is heat integrated with the top of the high pressure column by means of its bottom reboiler/ condenser, pretreats the crude liquid oxygen from the bottom of the high pressure column.

DETAILED DESCRIPTION OF THE INVENTION

The present invention is a process for the cryogenic distillation of an air feed to produce nitrogen. The process uses a distillation column system comprising at least a high pressure column, a low pressure column and an auxiliary low pressure separation zone. The separation zone, in turn, comprises at least a reboiler/condenser in its bottom and, in many embodiments, a distillation section located above the reboiler/condenser.

Figure 6:
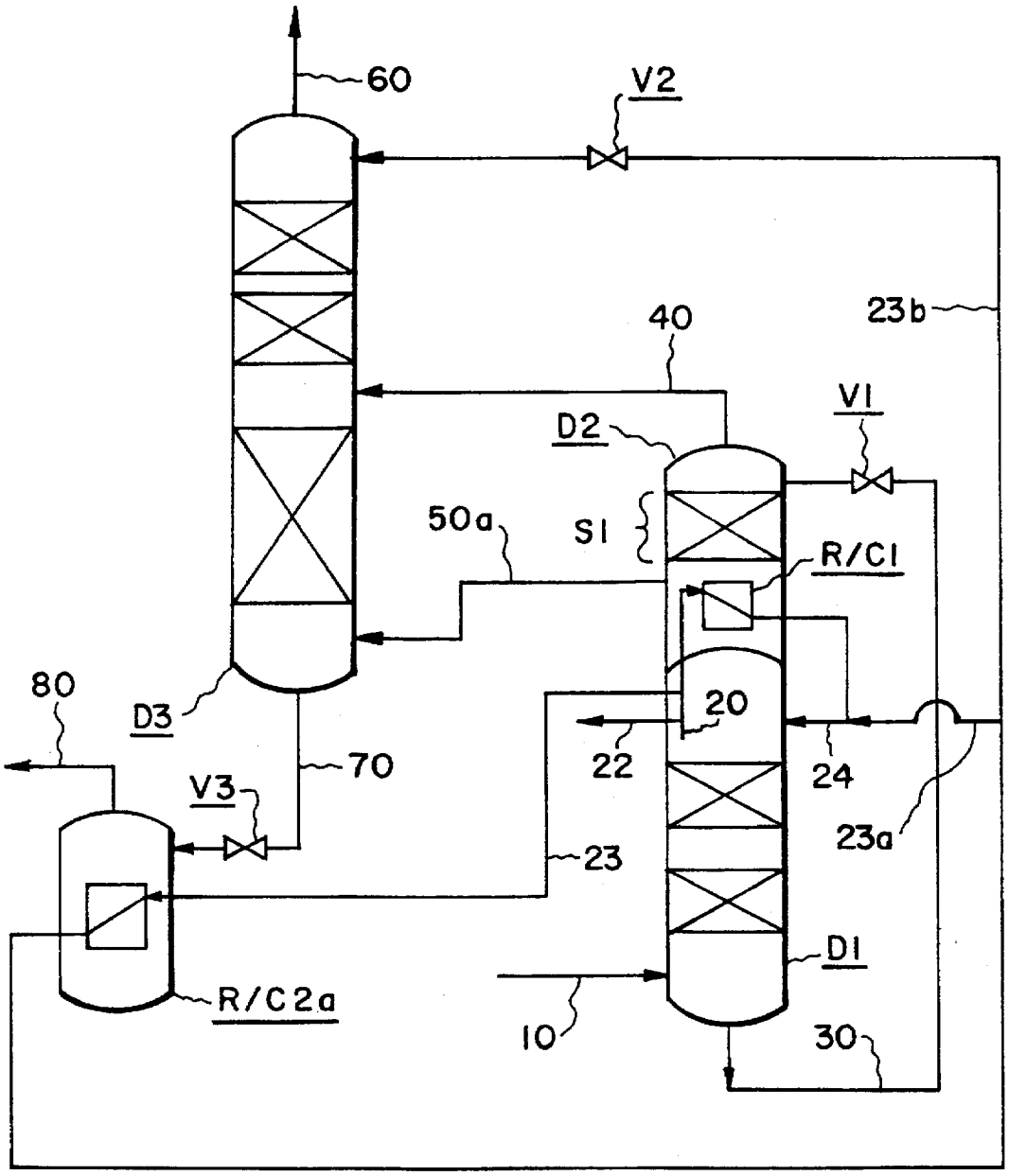
FIG. 6 is a schematic drawing of a sixth general embodiment of the present invention.

In its broadest embodiment, and with reference to any or all of FIGS. 1–12, the process of the present invention comprises:

(a) feeding at least a portion of the air feed [10] to the bottom of the high pressure column [D1];

(b) removing a nitrogen-enriched overhead [20] from the top of the high pressure column, collecting a first portion [22] as a high pressure nitrogen product, condensing a second portion in a first reboiler/condenser [R/C1] located in the bottom of the auxiliary low pressure separation zone [D2] and feeding at least a first part [24] of the condensed second portion as reflux to an upper location in the high pressure column;

(c) removing a crude liquid oxygen stream [30] from the bottom of the high pressure column, reducing the pressure of at least a first portion of it [across valve V1] and feeding said first portion to the top of the auxiliary low pressure separation zone;

(d) removing a crude nitrogen overhead [40] from the top of the auxiliary low pressure separation zone and feeding it directly as a vapor to the low pressure column [D3] wherein the auxiliary low pressure separation zone is operated at the same pressure as the low pressure column, plus the expected pressure drop between the auxiliary low pressure separation zone and the low pressure column;

(e) removing one or more oxygen-enriched streams [50*a*, 50*b*] from a lower location in the auxiliary low pressure separation zone in the vapor and/or liquid state and:

(i) feeding any portion thereof directly to the low pressure column; and/or (ii) discarding any vapor portion thereof as a waste stream; and/or (iii) at least partially vaporizing any liquid portion thereof at reduced pressure by indirect heat exchange against a third portion of the nitrogen-enriched overhead from the top of the high pressure column;

(f) removing a nitrogen rich overhead [60] from the top of the low pressure column, collecting at least an initial portion as a low pressure nitrogen product either directly as a vapor [62; 60 in FIG. 6] and/or as a liquid [66 except in FIG. 6] after condensing it in a second reboiler/condenser [R/C2 except in FIG. 6] located at the top of the low pressure column; and (g) removing a oxygen rich liquid stream [70] from the bottom of the low pressure column.

An important feature of the present invention is the auxiliary low pressure separation zone which can consist of a single reboiler/condenser or a distillation column with a reboiler/condenser in its bottom. Alternatively, the separation zone can consist of multiple reboiler/condensers and multiple distillation columns. The separation zone is heat integrated with the top of the high pressure column by means of its bottom reboiler/condenser. The separation zone allows better control of the process and more layout flexibility in terms of giving one the option to physically decouple the main low pressure column from the high pressure column.

As noted in step (d) above, the separation zone is operated at the same pressure as the low pressure column, plus the expected pressure drop between the auxiliary low pressure separation zone and the low pressure column. It was unexpectedly found that, within the range of possible operating pressures between the pressure of the high pressure column and the pressure of the low pressure column, this is the optimum operating pressure for the separation zone. In addition, this leads to simpler flowsheets with easy flow communication between the separation zone and the low pressure column.

In most embodiments of the present invention, and with reference to all but FIG. 6:

(i) step (f) further comprises condensing at least the remaining portion of the nitrogen rich overhead from the low pressure column in the second reboiler/condenser [R/C2] located at the top of the low pressure column and feeding at least a first part [64] as reflux to an upper location in the low pressure column;

(ii) step (g) further comprises reducing the pressure of the oxygen rich liquid stream [70] [across valve V2], vaporizing it in the second reboiler/condenser [R/C2]

located at the top of the low pressure column and discarding the vaporized stream [80] as a waste stream; and (iii) the entire amount of the nitrogen-enriched overhead [20] which is removed from the top of the high pressure column is condensed by indirect heat exchange against vaporizing oxygen-enriched liquid from the bottom of the auxiliary low pressure separation zone except for the portion [22] which is removed as the high pressure nitrogen product. (This is unlike U.S. Pat. No. 5,231,837 by Ha discussed earlier where a portion of the overhead from the top of the high pressure column is also condensed against vaporizing oxygen-enriched liquid from the bottom of the low pressure column. In Ha, the top of the high pressure column is heat integrated with both the bottom of Ha's intermediate pressure column and the bottom of Ha's low pressure column. As a consequence, the feed air pressure must be higher in Ha which leads to an increased energy requirement.)

Figure 5:
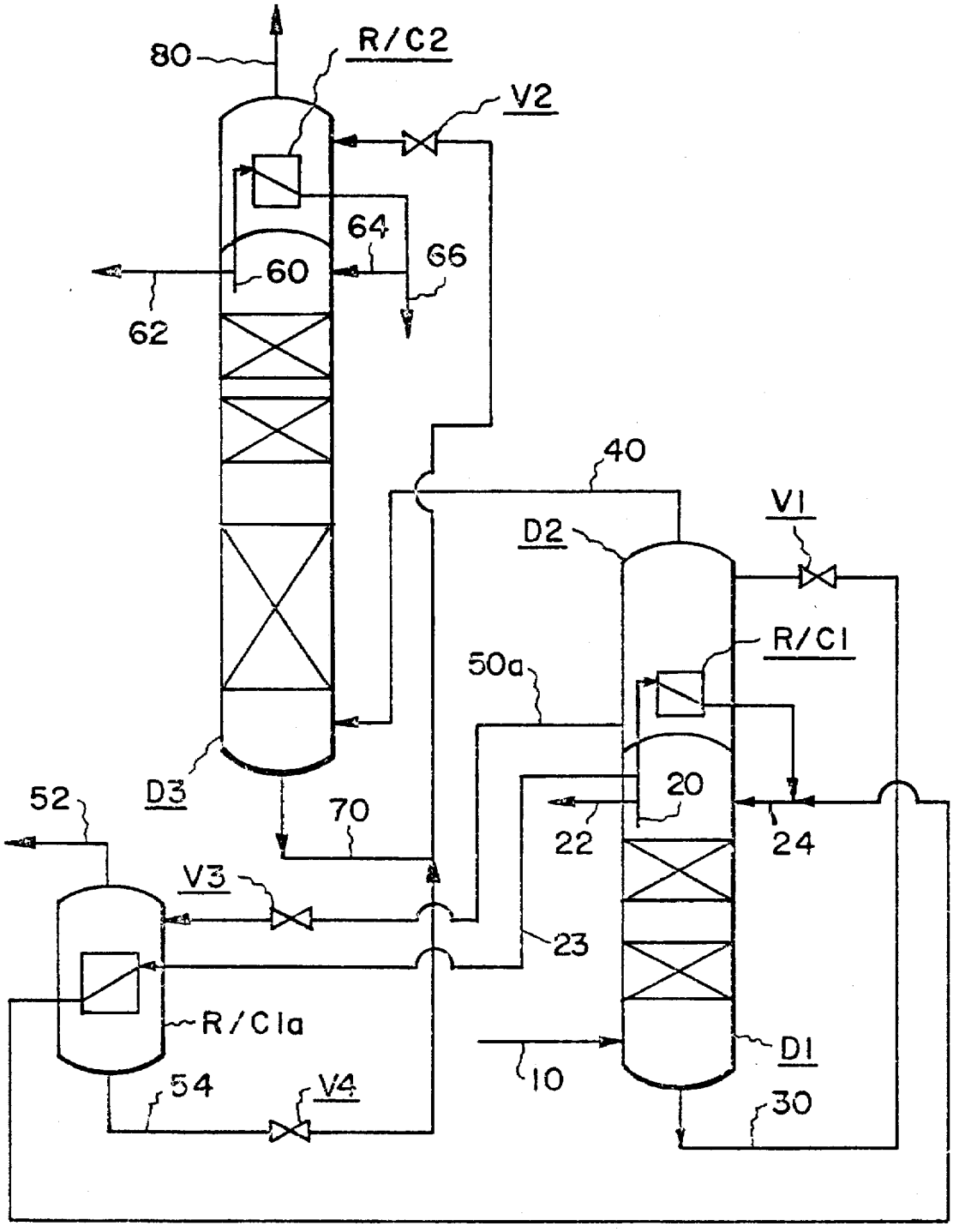
FIG. 5 is a schematic drawing of a fifth general embodiment of the present invention.

Also in most embodiments of the present invention, and with reference to all but FIG. 5:

(i) at least one of the one or more oxygen-enriched streams which is removed from the auxiliary low pressure separation zone in step (e) is removed in a state which is at least partially vapor; and (ii) in step (d), the crude nitrogen overhead [40] from the auxiliary low pressure separation zone is more specifically fed to an intermediate location in the low pressure column.

Figure 1:
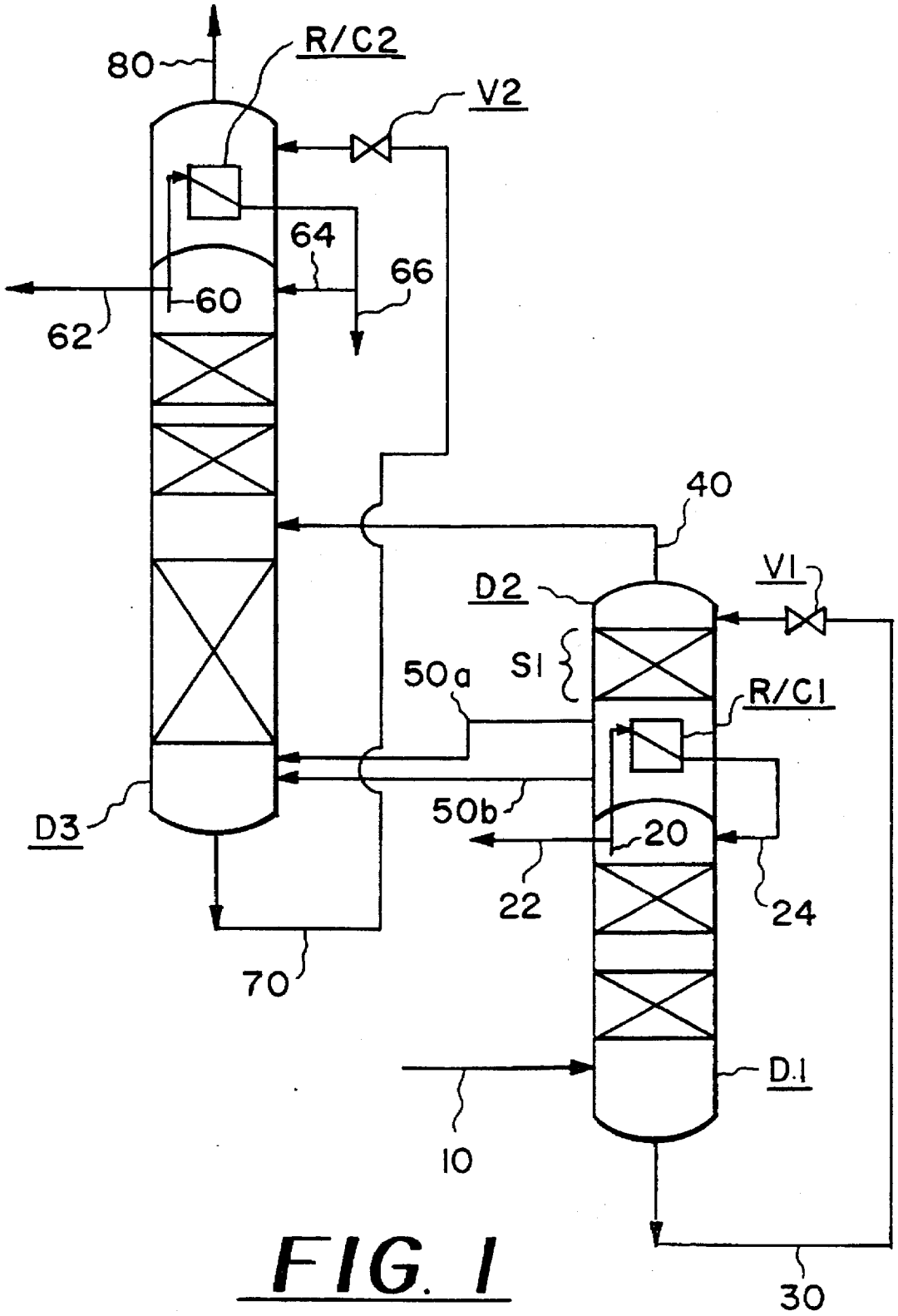
FIG. 1 is a schematic drawing of one general embodiment of the present invention.

In one general embodiment of the present invention, and with specific reference to FIG. 1:

(i) the auxiliary low pressure separation zone further comprises a distillation section [S1] located above the first reboiler/condenser [R/C1]; and (ii) step (e) more specifically comprises removing a first oxygen-enriched vapor stream [50*a*] from a location in the auxiliary low pressure separation zone between the distillation section and the first reboiler/condenser, removing a second oxygen-enriched liquid stream [50*b*] from the bottom of the auxiliary low pressure separation zone and feeding the first and second oxygen-enriched streams to the bottom of the low pressure column.

In FIG. 1, it is generally sufficient for the separation zone's distillation section [S1] to have ten or less stages (or a packing height equivalent to ten or less stages). Also in FIG. 1, the purity of the low pressure nitrogen product [62] can be equal to, lower than or even higher than the purity of the high pressure nitrogen product [22], depending on one's needs. To achieve the desired purity level of this stream, an appropriate number of stages or packing height for the low pressure column must be provided.

Figure 2:
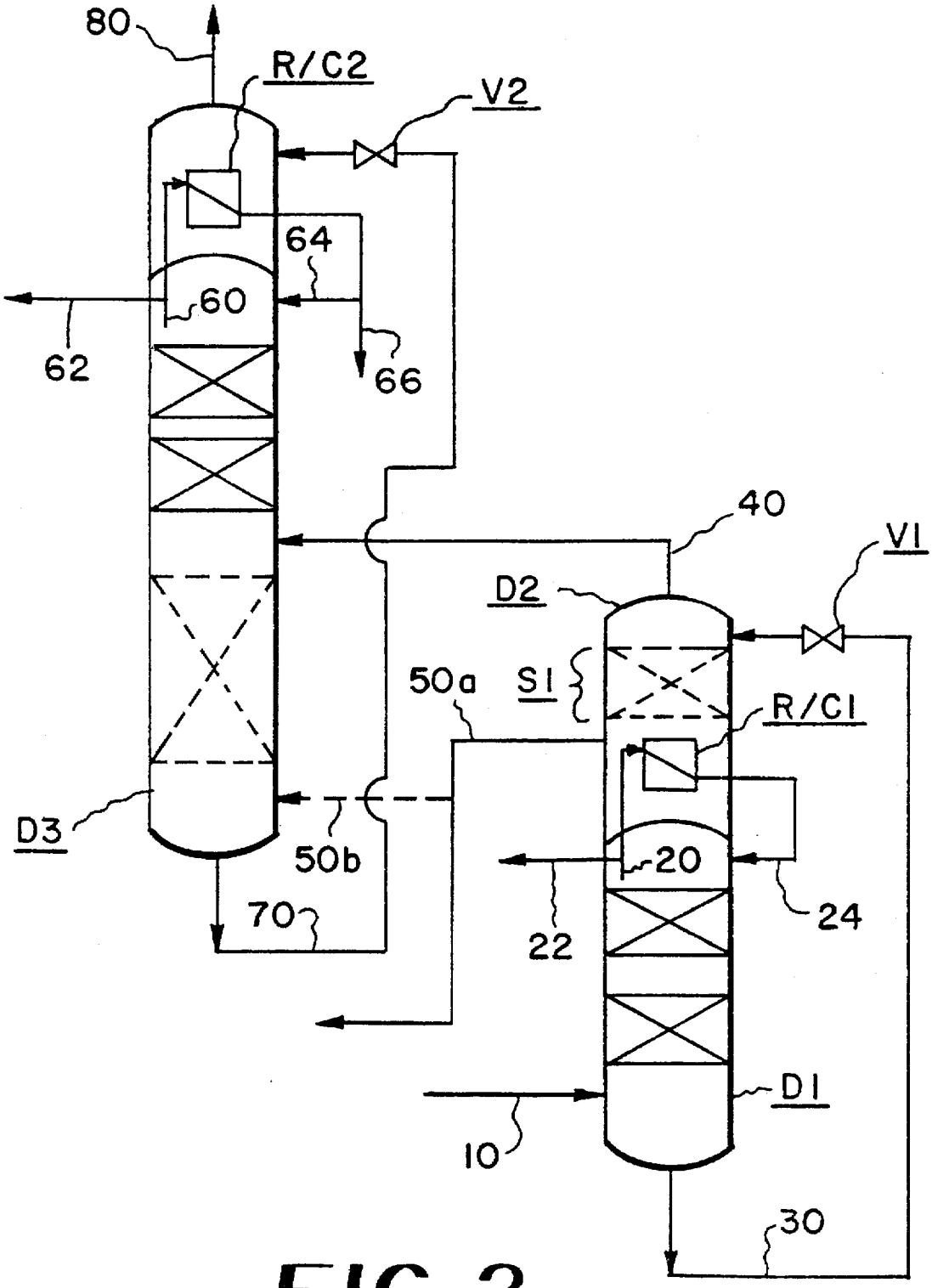
FIG. 2 is a schematic drawing of a second general embodiment of the present invention.

In a second general embodiment of the present invention, and with specific reference to FIG. 2:

(i) step (e) more specifically comprises removing a single oxygen-enriched vapor stream [50*a*] from an intermediate location in the auxiliary low pressure separation zone and discarding it as a waste stream;

(ii) the auxiliary low pressure separation zone optionally further comprises a distillation section [S1] located above the first reboiler/condenser [R/C1], in which case the single oxygen-enriched vapor stream [50*a*] removed in step (e) is more specifically removed from a location in the auxiliary low pressure separation zone between the distillation section and the first reboiler/condenser; and (iii) step (e) optionally further comprises feeding a second part [50*b*] of the single oxygen-enriched vapor stream to the bottom of the low pressure column.

In FIG. 2, if the option to step (e) discussed in (iii) above is not performed, then the distillation section shown in the bottom of the low pressure column in FIG. 2 would not be necessary.

Figure 3:
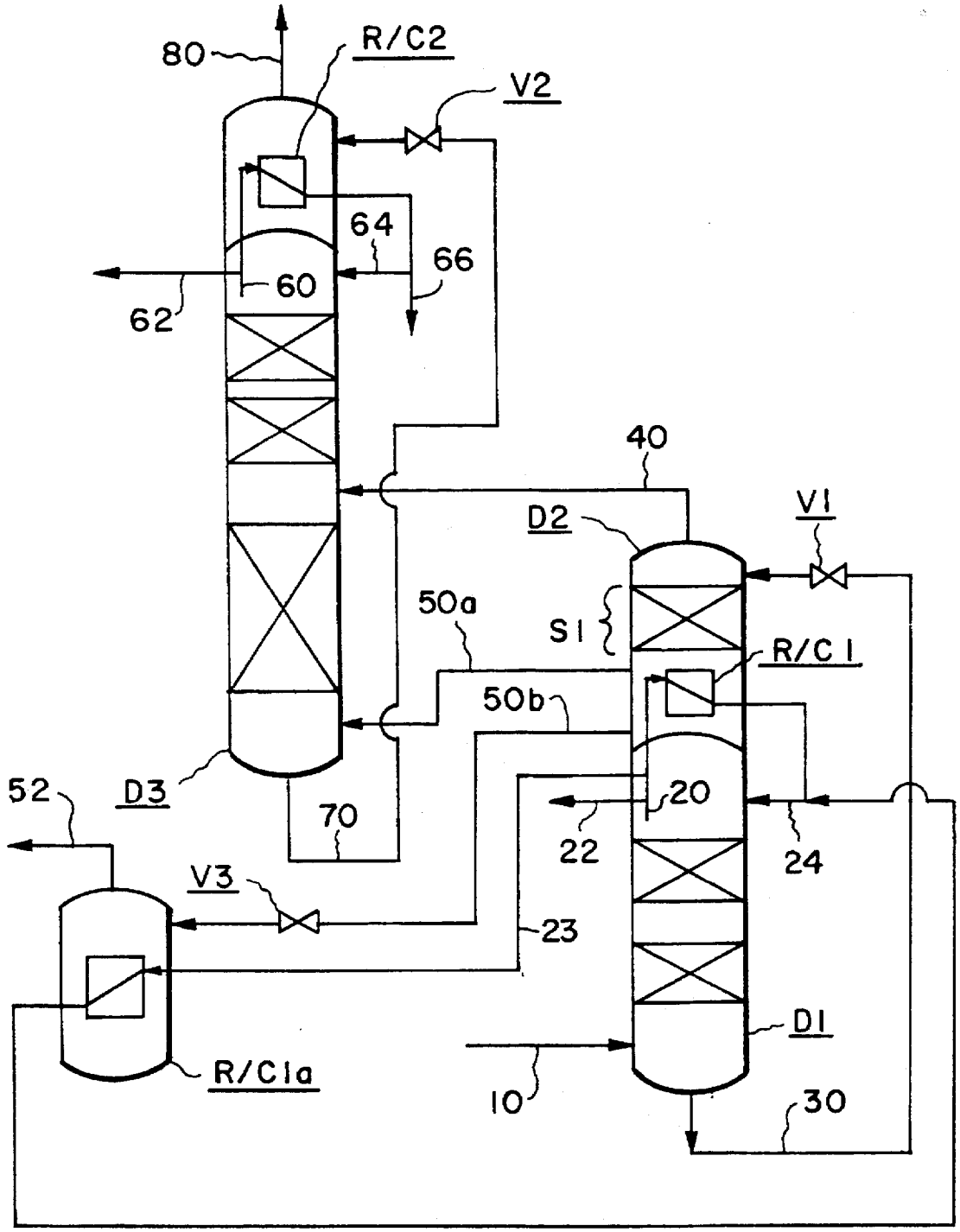
FIG. 3 is a schematic drawing of a third general embodiment of the present invention.

In a third general embodiment of the present invention, and with specific reference to FIG. 3:

(i) the auxiliary low pressure separation zone further comprises a distillation section [S1] located above the first reboiler/condenser [R/C1] in addition to further comprising a first auxiliary reboiler/condenser [R/C1 *a*];

(ii) step (b) further comprises condensing a third portion [23] of the nitrogen-enriched overhead from the top of the high pressure column in the first auxiliary reboiler/condenser [R/C1*a*] and feeding at least a first part of the condensed third portion as reflux to an upper location in the high pressure column; and (iii) step (e) more specifically comprises removing a first oxygen-enriched stream [50*a*] from a location in the auxiliary low pressure separation zone between the distillation section and the first reboiler/condenser [R/C1] and feeding it to the bottom of the low pressure column, removing a second oxygen-enriched liquid stream [50*b*] from the bottom of the auxiliary low pressure separation zone, reducing its pressure [across valve V3], vaporizing it in the first auxiliary reboiler/condenser and discarding the vaporized stream [52] as a waste stream.

Figure 4:
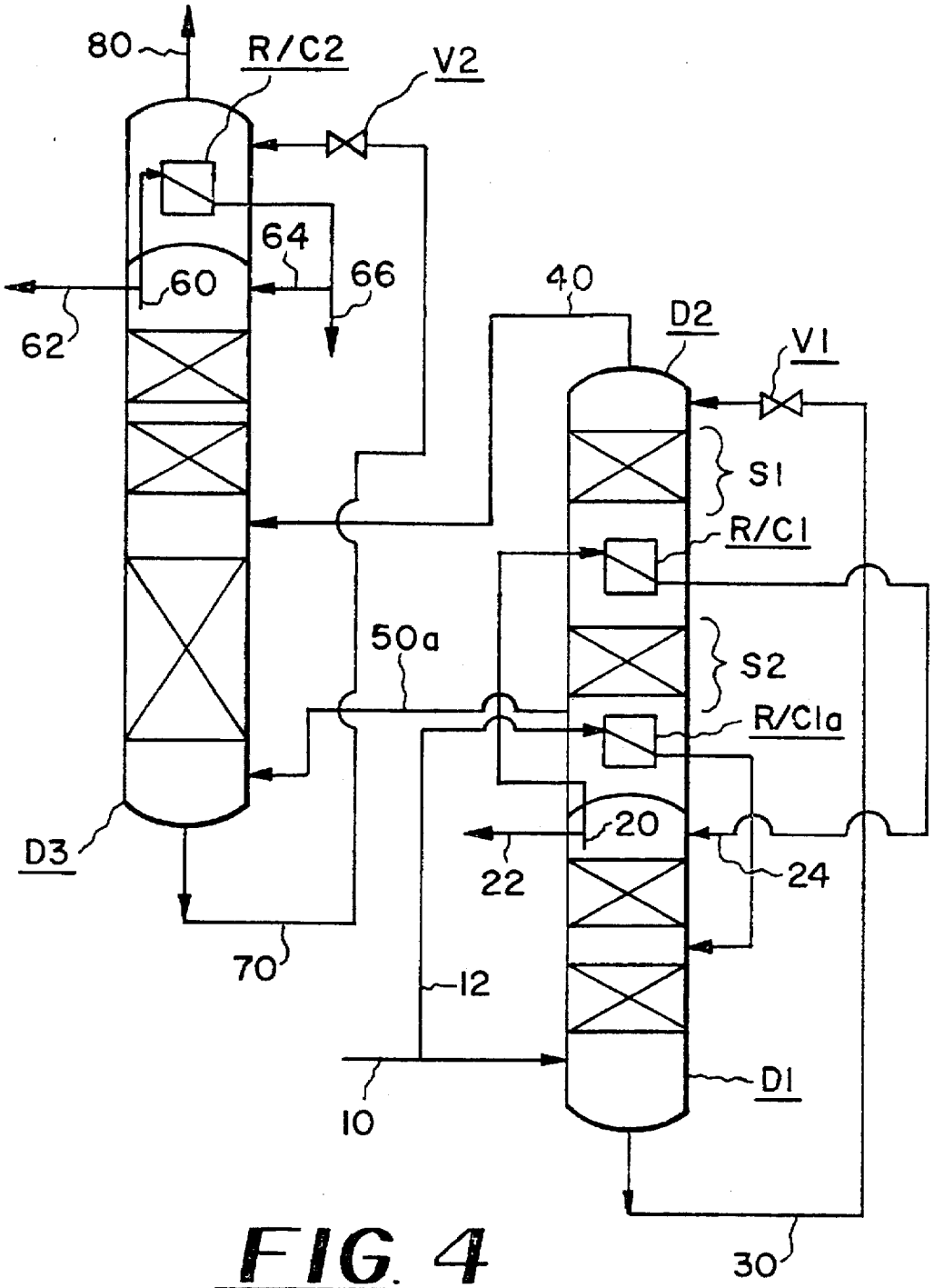
FIG. 4 is a schematic drawing of a fourth general embodiment of the present invention.

In a fourth general embodiment of the present invention, and with specific reference to FIG. 4:

(i) the auxiliary low pressure separation zone further comprises a first distillation section [S1] located above the first reboiler/condenser [R/C1], a second distillation section [S2] located below the first reboiler/condenser [R/C1] and a first auxiliary reboiler/condenser [R/C1*a*] located below the second distillation section;

(ii) step (e) more specifically comprises removing a single oxygen-enriched stream [50*a*] from a location in the auxiliary low pressure separation zone between the second distillation section and the first auxiliary reboiler/condenser [R/C1*a*] and feeding it to the bottom of the low pressure column; and (iii) a second portion [12] of the air feed is condensed in the first auxiliary reboiler/condenser [R/C1*a*] and fed as reflux to an intermediate location in the high pressure column.

In FIG. 4, application of two reboiler/condensers instead of one in the separation zone reduces process irreversibility. Any suitable fluids could be condensed in these reboiler/condensers. For example, a portion of the high pressure nitrogen overhead in stream [20] could be boosted in pressure and then condensed in the first auxiliary reboiler/condenser [R/C1*a*], either totally or partly replacing the air stream [12].

In a fifth general embodiment of the present invention, and with specific reference to FIG. 5:

(i) the auxiliary low pressure separation zone further comprises a first auxiliary reboiler/condenser [R/C1*a*];

(ii) step (b) further comprises condensing a third portion [23] of the nitrogen-enriched overhead from the top of the high pressure column in the first auxiliary reboiler/condenser [R/C1*a*] and feeding at least a first part of the condensed third portion as reflux to an upper location in the high pressure column;

(iii) in step (d), the crude nitrogen overhead [40] from the auxiliary low pressure separation zone is more specifically fed to the bottom of the low pressure column; and (iv) step (e) more specifically comprises removing a single oxygen-enriched liquid stream [50*a*] from the bottom of the auxiliary low pressure separation zone, reducing its pressure [across valve V3], partially vaporizing it in the first auxiliary reboiler condenser [R/C1*a*], discarding the vaporized stream [52] as a waste stream, reducing the pressure of the remaining liquid portion [54] [across valve V4] and combining the remaining liquid portion with the oxygen rich liquid stream [70] from the bottom of the low pressure column.

In a sixth general embodiment of the present invention, and with specific reference to FIG. 6:

(i) the auxiliary low pressure separation zone further comprises a distillation section [S1] located above the first reboiler/condenser [R/C1];

(ii) step (b) further comprises condensing a third portion [23] of the nitrogen-enriched overhead from the top of the high pressure column in a second auxiliary reboiler/condenser [R/C2*a*], feeding a first part [23*a*] of the condensed third portion as reflux to an upper location in the high pressure column, reducing the pressure of a second part [23*b*] [across valve V2] and feeding the second part as reflux to an upper location in the low pressure column;

(iii) step (e) more specifically comprises removing a first oxygen-enriched stream [50*a*] from a location in the auxiliary low pressure separation zone between the distillation section and the first reboiler/condenser and feeding it to the bottom of the low pressure column; and (iv) step (g) further comprises reducing the pressure of the oxygen rich liquid stream [70] [across valve V3], vaporizing it in the second auxiliary reboiler/condenser [R/C2*a*] and discarding the vaporized stream [80] as a waste stream.

Figure 7:
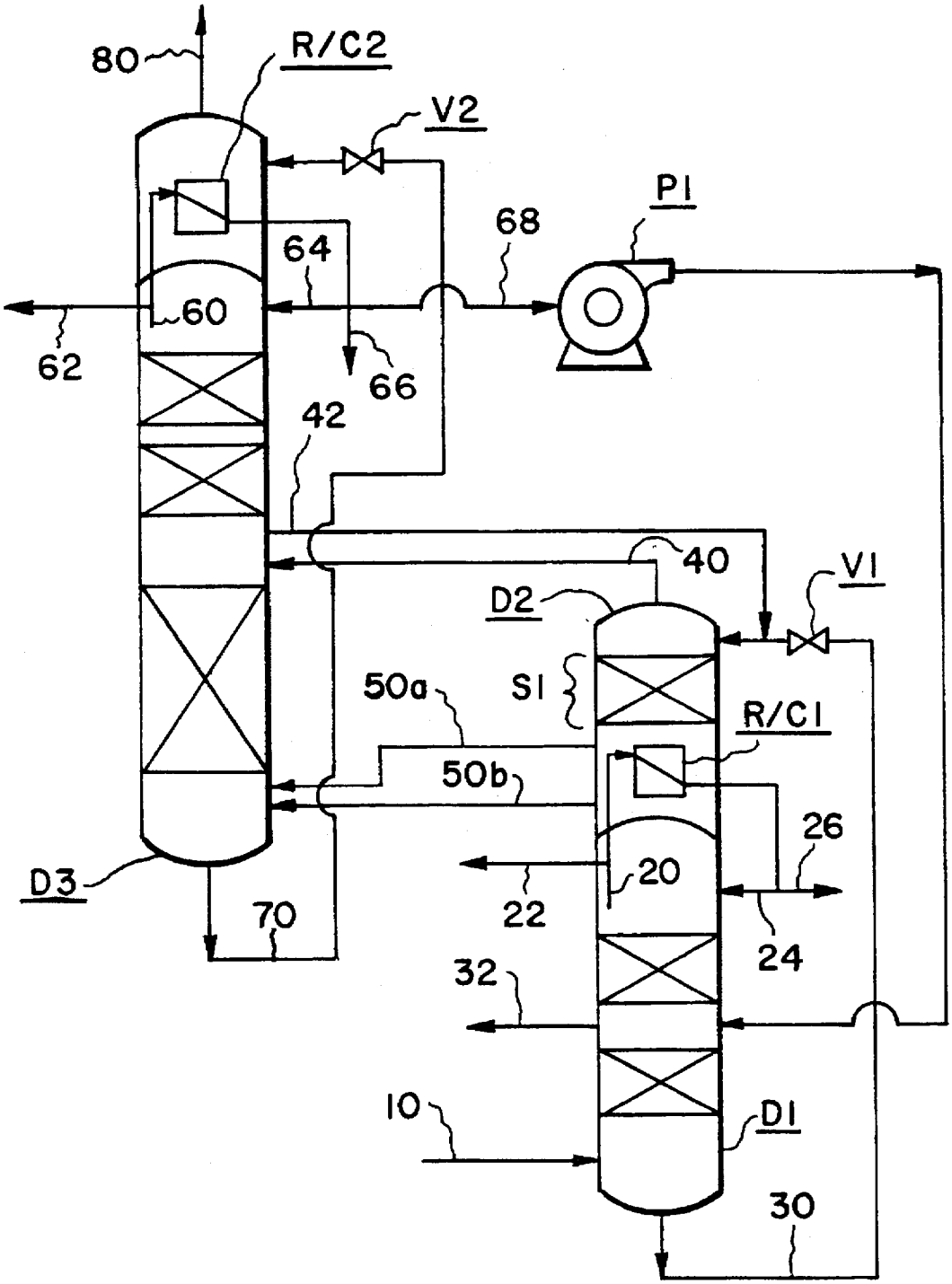
FIG. 7 is a schematic drawing of one embodiment of FIG. 1 which illustrates one example of a further integration between the columns and/or separation zone of the present invention.
Figure 8:
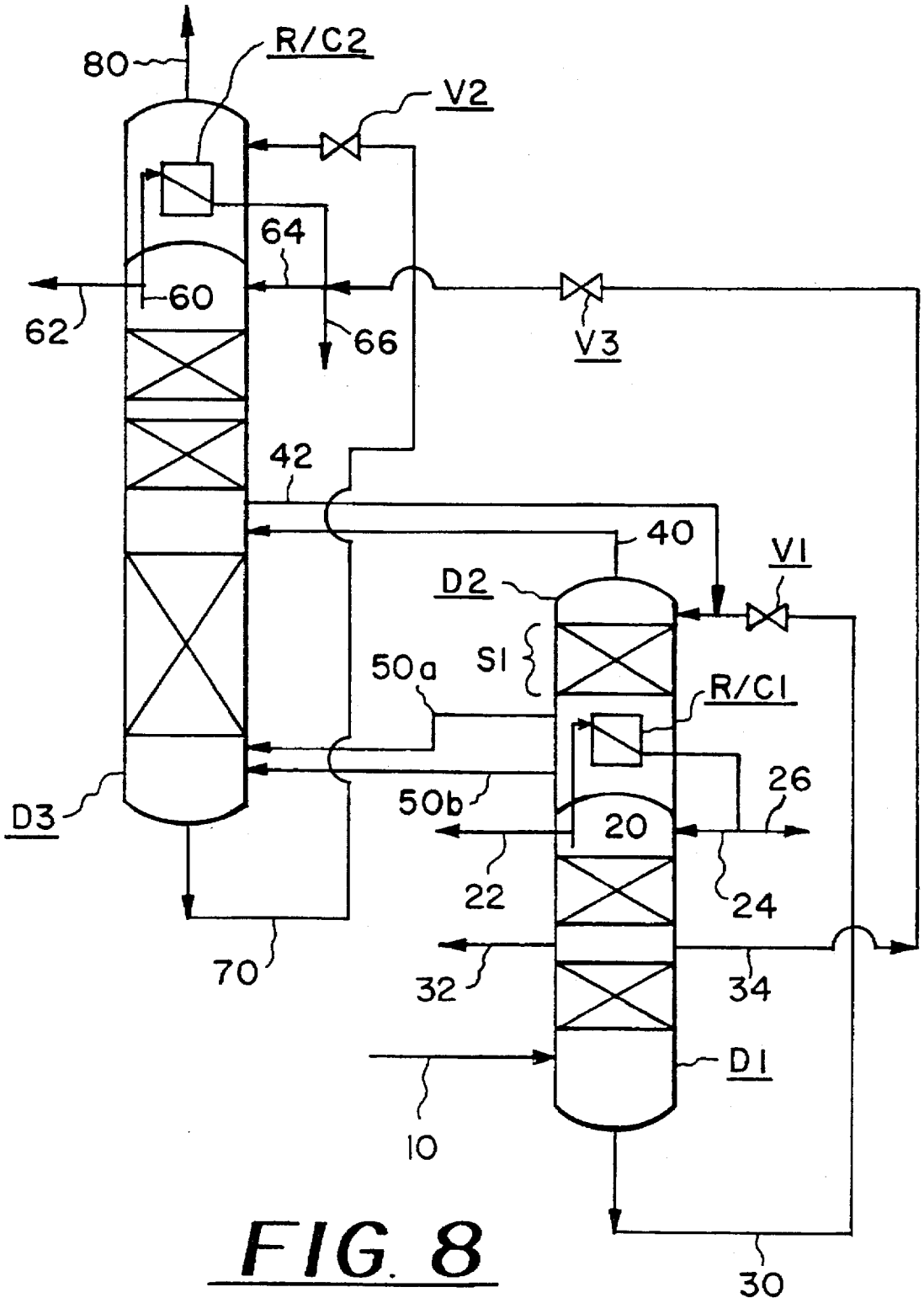
FIG. 8 is a schematic drawing of a second embodiment of FIG. 1 which illustrates a second example of a further integration between the columns and/or separation zone of the present invention.

In FIG. 6, it is also possible to feed the entire third portion [23] of the nitrogen-enriched overhead from the top of the high pressure column as discussed in (ii) above as reflux to either the high pressure column or the low pressure column It should be noted that there are many opportunities for further integration in the above general embodiments between the columns and/or separation zone of the present invention. FIGS. 7 and 8 are two examples as applied to FIG. 1 (common streams and equipment use the same identification as in FIG. 1).

With reference to FIG. 7:

(i) a portion of the nitrogen-enriched vapor [32] ascending the high pressure column is removed from an intermediate location in the high pressure column as additional high pressure nitrogen product;

(ii) a second part [26] of the condensed second portion of the nitrogen-enriched overhead from the high pressure column is collected as additional high pressure nitrogen product;

(iii) a portion of the oxygen-enriched liquid [42] descending the low pressure column is removed from an intermediate location in the low pressure column and fed to the top of the auxiliary low pressure separation zone; and (iv) in step (f), a second part [68] of the condensed nitrogen rich overhead from the low pressure column is pumped to an elevated pressure [in pump P1] and fed to an intermediate location in the high pressure column.

In FIG. 7, the liquid nitrogen recycle [68] to the high pressure column in (iv) above increases the recovery of the high pressure nitrogen products [22, 26, 32] from the high pressure column. Also in FIG. 7, the oxygen-enriched liquid [42] recycle to the separation zone in (iii) above further increases recovery of the liquid high pressure nitrogen product [26] from the high pressure column.

FIG. 8 is identical to FIG. 7 except that the step described in (iv) above is replaced by the following:

(iv) a portion of the nitrogen-enriched liquid [34] descending the high pressure column is removed from an intermediate location in the high pressure column, reduced in pressure [across valve V3] and fed to the top of the low pressure column.

In FIG. 8, stream [34] should be withdrawn from an appropriate level below the top of the high pressure column, especially if the purity of the low pressure nitrogen product [62, 66] is lower than the purity of the high pressure nitrogen product [22, 26, 32]. If these purities are equal, stream [34] can be withdrawn from the top of the high pressure column.

Figure 9:
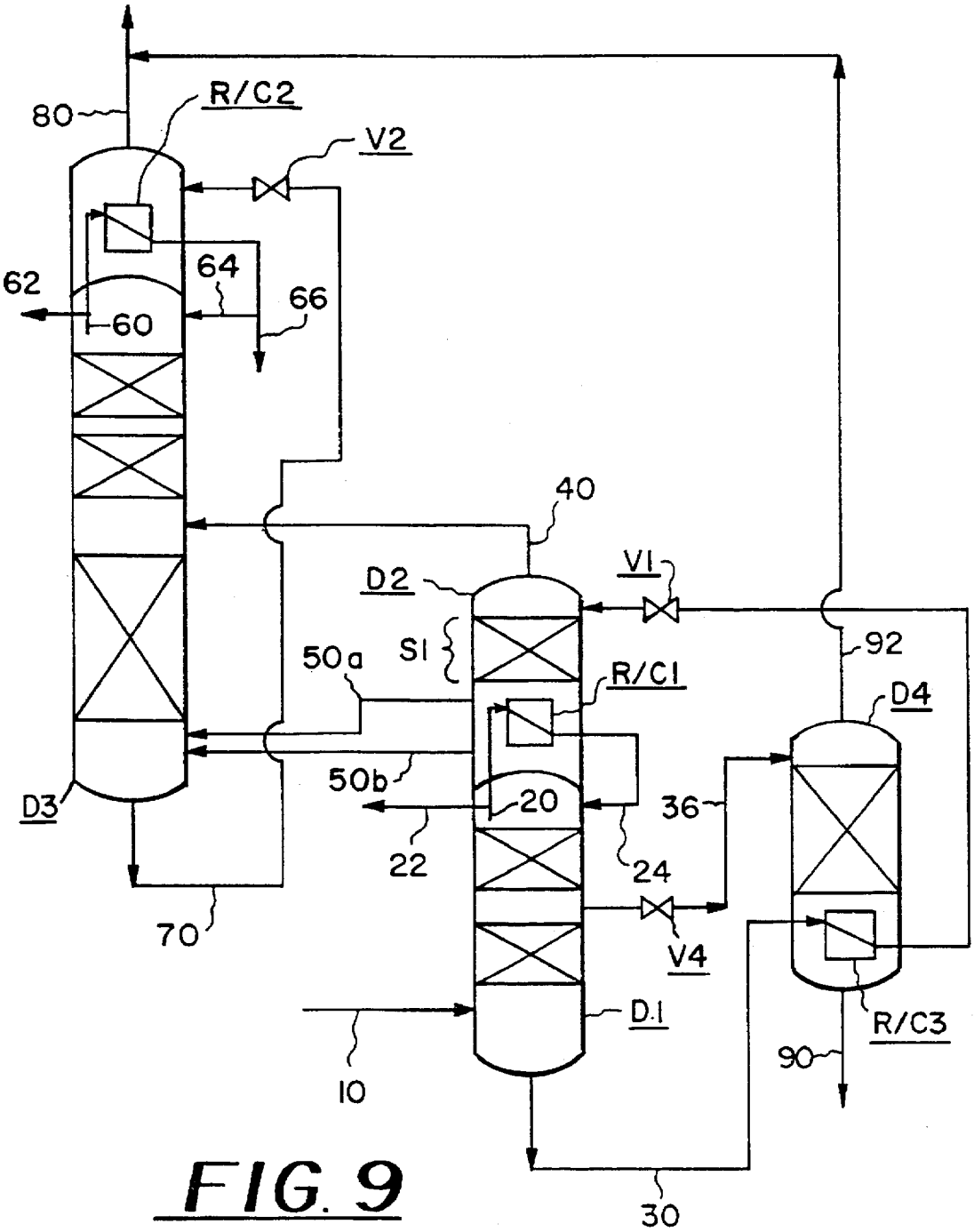
FIG. 9 is a schematic drawing of a third of embodiment of FIG. 1 which illustrates one example of how the present invention can be integrated with a liquid oxygen producing column.
Figure 10:
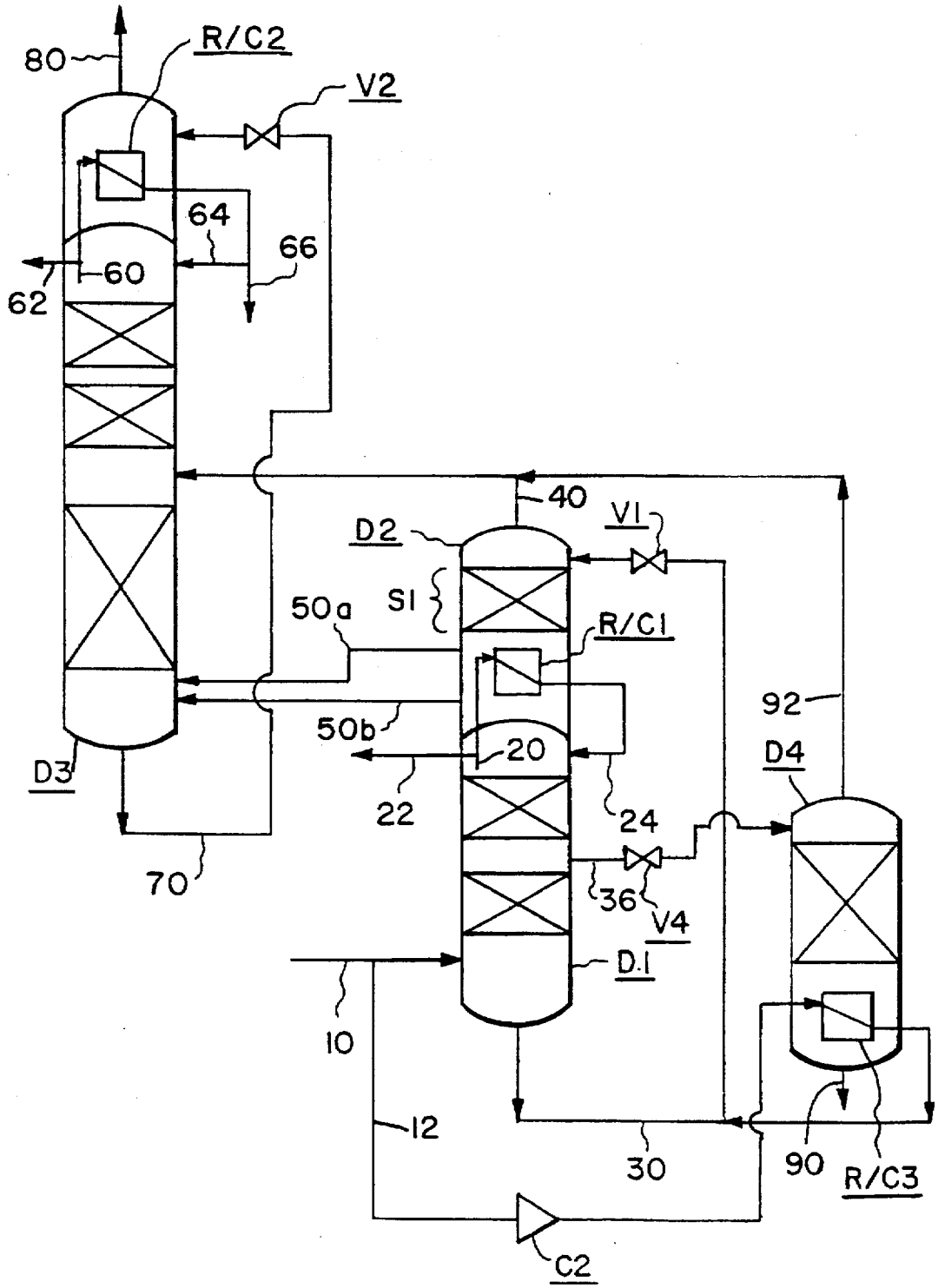
FIG. 10 is a schematic drawing of a fourth embodiment of FIG. 1 which illustrates a second example of how the present invention can be integrated with a liquid oxygen producing column.
Figure 11:
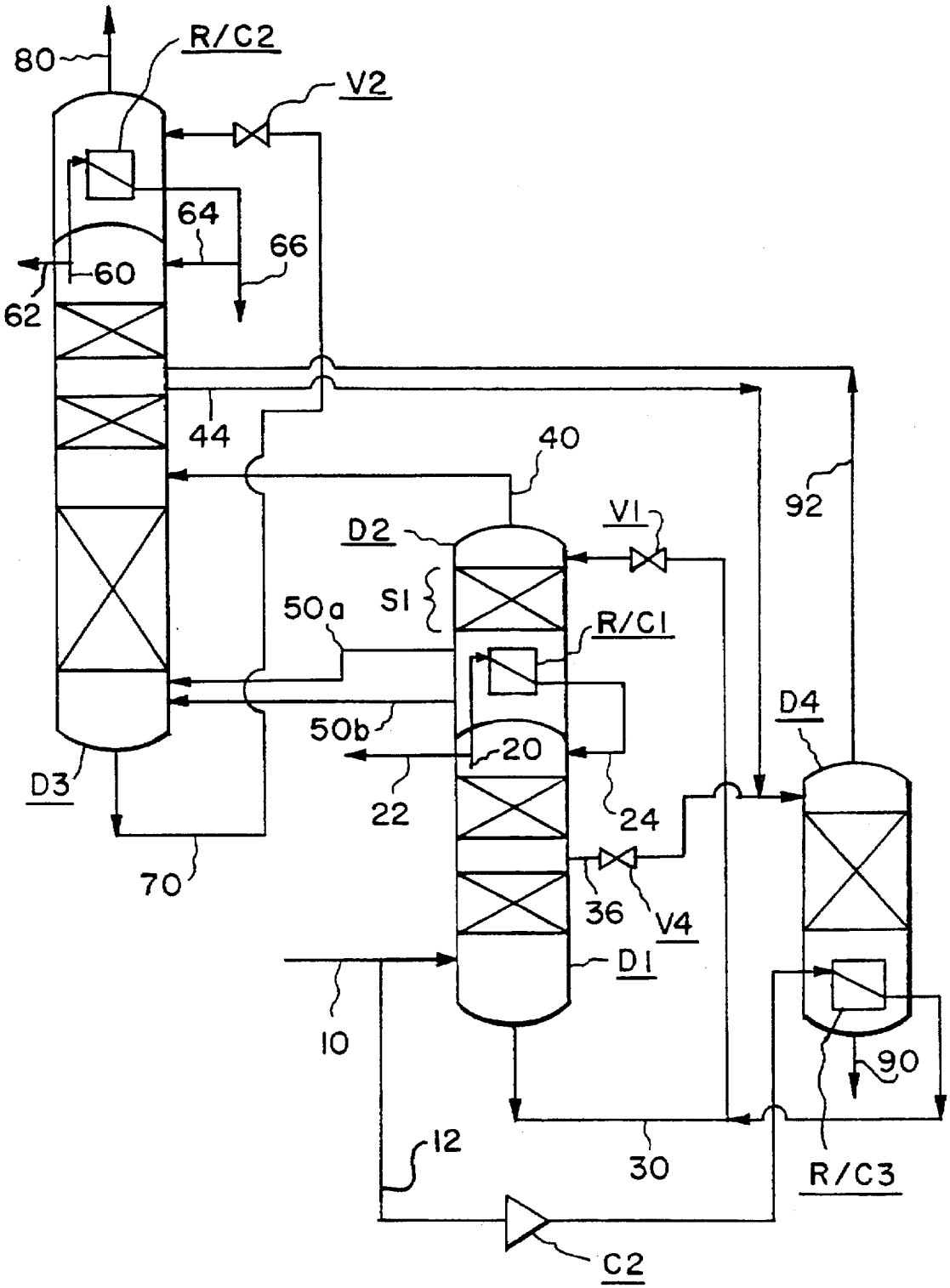
FIG. 11 is a schematic drawing of a fifth embodiment of FIG. 1 which illustrates a third example of how the present invention can be integrated with a liquid oxygen producing column.

It should further be noted that the present invention can be integrated with a liquid oxygen producing column to produce an ultra high purity liquid oxygen product. FIGS. 9, 10, and 11 are three examples as applied to FIG. 1 (common streams and equipment use the same identification as in FIG. 1).

With reference to FIG. 9:

(i) the distillation column system further comprises a liquid oxygen producing column [D4] containing a third reboiler/condenser [R/C3] in its bottom;

(ii) a hydrocarbon-depleted stream [36] is removed from an intermediate location in the high pressure column, reduced in pressure [across valve V4] and fed to the top of the liquid oxygen producing column;

(iii) prior to reducing the pressure of the first portion of the crude liquid oxygen stream [30] from the bottom of the high pressure column and feeding it to the top of the auxiliary low pressure separation zone, said first portion is subcooled in the third reboiler/condenser [R/C3];

(iv) an overhead stream [92] is removed from the top of the liquid oxygen producing column and combined with the waste stream [80]; and (v) a liquid oxygen product [90] is removed from the bottom of the liquid oxygen producing column.

In FIG. 9, the liquid oxygen producing column operates at a pressure close to atmospheric pressure, preferably at 16–30 psia. The withdrawal location of stream [36] in FIG. 9 is selected high enough in the high pressure column such that all components less volatile than oxygen (especially hydrocarbons) are no longer present in the liquid phase or their concentration is below the acceptable limit.

With reference to FIG. 10:

(i) the distillation column system further comprises a liquid oxygen producing column [D4] containing a third reboiler/condenser [R/C3] in its bottom;

(ii) a hydrocarbon-depleted stream [36] is removed from an intermediate location in the high pressure column, reduced in pressure [across valve V4] and fed to the top of the liquid oxygen producing column;

(iii) a second portion [12] of the air feed is further compressed [in compressor C2], at least partially condensed in the third reboiler/condenser [R/C3], combined with the first portion of the crude liquid oxygen stream [30] from the bottom of the high pressure column and fed to the top of the auxiliary low pressure separation zone;

(iv) an overhead stream [92] is removed from the top of the liquid oxygen producing column, combined with the crude nitrogen overhead [40] from the top of the auxiliary low pressure separation zone and fed to an intermediate location in the low pressure column; and (v) a liquid oxygen product [90] is removed from the bottom of the liquid oxygen producing column.

In FIG. 10, the liquid oxygen producing column operates at an increased pressure vs FIG. 9 (preferably 30–70 psia) which is high enough so that the overhead stream [92] can be fed directly to the low pressure column, or as shown, combined with the crude nitrogen overhead [40] from the top of the separation zone and fed to an intermediate location in the low pressure column. This increases the overall nitrogen recovery as compared to FIG. 9. Also in FIG. 10, the at least partially condensed air exiting the third reboiler/condenser [R/C3] may alternatively be fed directly to a suitable location in the high pressure column and/or the low pressure column.

With reference to FIG. 11:

(i) the distillation column system further comprises a liquid oxygen producing column [D4] containing a third reboiler/condenser [R/C3] in its bottom;

(ii) a hydrocarbon-depleted stream [36] is removed from an intermediate location in the high pressure column, reduced in pressure [across valve V4] and fed to the top of the liquid oxygen producing column;

(iii) a second portion [12] of the air feed is further compressed [in compressor C2], at least partially condensed in the third reboiler/condenser [RIC3], combined with the first portion of the crude liquid oxygen stream [30] from the bottom of the high pressure column and fed to the top of the auxiliary low pressure separation zone;

(iv) a hydrocarbon-depleted stream [44] is removed from an upper intermediate location in the low pressure column and combined with the hydrocarbon-depleted stream [36] which is removed from the high pressure column;

(v) an overhead stream [92] is removed from the top of the liquid oxygen producing column and fed to an upper intermediate location in the auxiliary low pressure separation zone; and (vi) a liquid oxygen product [90] is removed from the bottom of the liquid oxygen producing column.

In FIG. 11, stream [44] can be a standalone feed to the liquid oxygen producing column, or as shown, an additional feed along with stream [36]. Also in FIG. 11, the overhead stream [92] is preferably returned to the low pressure column at the same location where stream [44] is withdrawn. Alternatively, if the pressure of the liquid oxygen producing column [D4] is lower than the pressure of the low pressure column, then the overhead stream [92] can be combined with the waste stream [80].

Figure 12:
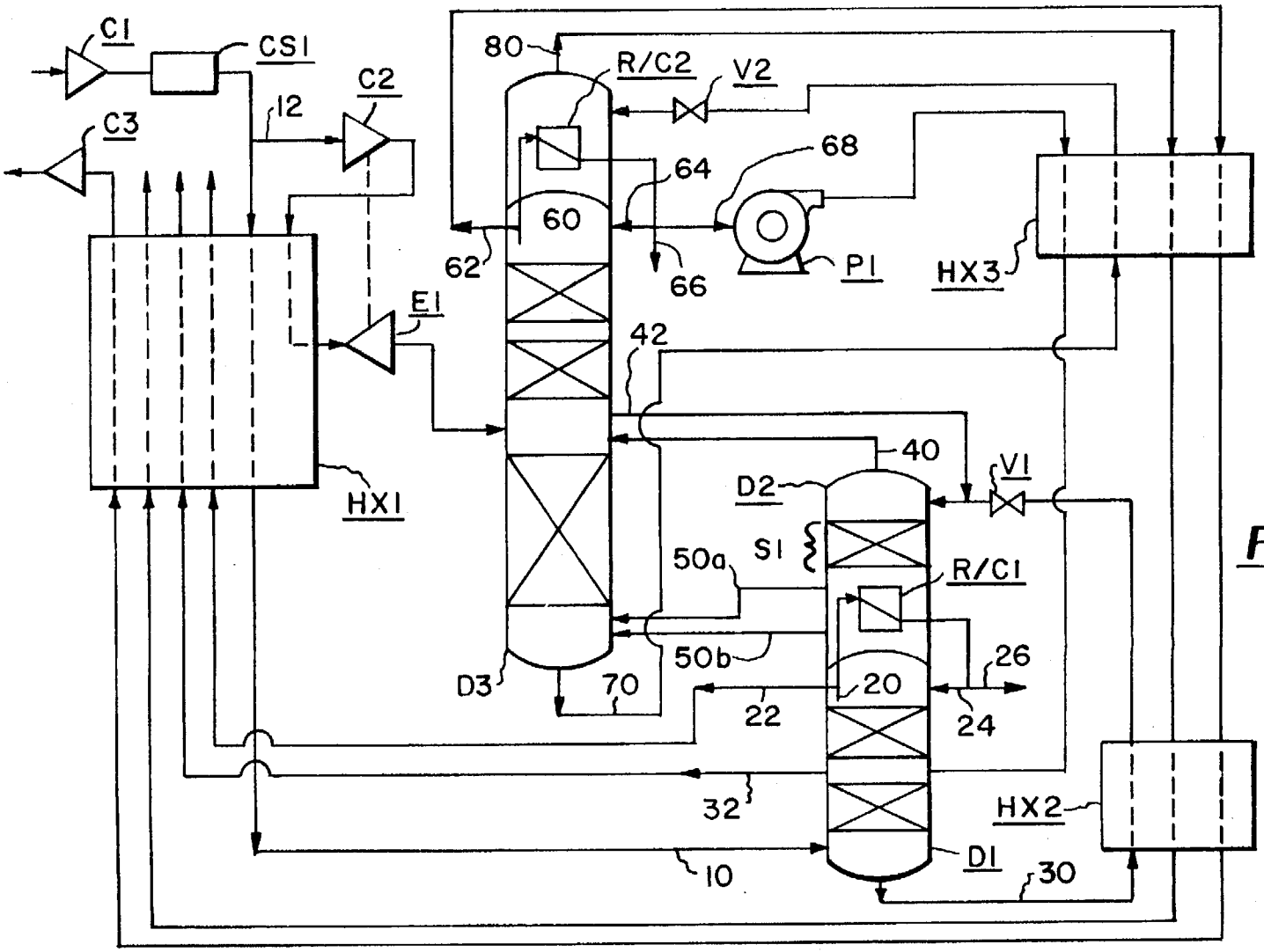
FIG. 12 is a schematic drawing of a first embodiment of FIG. 7 which illustrates one example of how the various embodiments of the present invention can be integrated with a main heat exchanger, subcooling heat exchangers and a refrigeration generating expander.

It should further be noted that, for simplicity, the main heat exchanger and the refrigeration generating expander scheme have been omitted from FIGS. 1–11. The main heat exchanger and the various expander schemes can easily be incorporated by one skilled in the art. The candidates of likely streams to be expanded include:

(i) at least a portion of the air feed, which after expansion, would generally be fed to an appropriate location in the distillation column system (as an example, this scheme is shown in FIG. 12 discussed below); and/or (ii) at least a portion of one or more of the waste streams that are produced in the various embodiments, which after expansion, would generally be warmed in the main heat exchanger against the incoming air feed; and/or (iii) at least a portion of the low pressure nitrogen product from the top of the low pressure column (especially where this product stream must first be compressed to a final product specification), which after expansion, would generally be warmed in the main heat exchanger against the incoming air feed; and/or (iv) at least a portion of the high pressure nitrogen product (especially where high production of the high pressure nitrogen product is not needed), which after expansion, would generally be warmed in the main heat exchanger against the incoming air feed.

It should further be noted that, for simplicity, other ordinary features of an air separation process have been omitted from FIGS. 1–11, including the main air compressor, the front end clean-up system, the subcooling heat exchangers and, if required, product compressors. These features can also easily be incorporated by one skilled in the art. FIG. 12, as applied to FIG. 7 (common streams and equipment use the same identification as in FIG. 7) is one example of how these ordinary features (including the main heat exchanger and an expander scheme) can be incorporated.

With reference to FIG. 12:

(i) prior to feeding the air feed to the bottom of the high pressure column in step (a), the air feed is compressed [in compressor C1], cleaned [in a clean-up system CS1] of impurities which will freeze out at cryogenic temperatures tie water and carbon dioxide) and/or other undesirable impurities (such as carbon monoxide and hydrogen) and cooled in a main heat exchanger [HX1] to a temperature near its dew point;

(ii) prior to cooling the air feed stream in the main heat exchanger, an air expansion stream [12] is removed, further compressed [in compander compressor C2], partially cooled in the main heat exchanger and turbo-expanded [in expander E1] and fed to an intermediate location in the low pressure column;

(iii) the high pressure nitrogen product [22, 32], low pressure nitrogen product [62] and waste stream [80] are warmed in the main heat exchanger;

(iv) prior to warming the low pressure nitrogen product [62] and waste stream [80] in the main heat exchanger, said streams are warmed in a first subcooling heat exchanger [HX2] against the crude liquid oxygen stream [30] from the bottom of the high pressure column;

(v) prior to warming the low pressure nitrogen product [62] and waste stream [80] in the first subcooling heat exchanger [HX2], said streams, along with the second part [68] of the condensed nitrogen rich overhead from the low pressure column, are warmed in a second subcooling heat exchanger [HX3] against the oxygen rich liquid stream [70] from the bottom of the low pressure column; and (vi) after being warmed in the main heat exchanger, the low pressure nitrogen product [62] is compressed to an elevated pressure [in compressor C3].

Computer simulations have demonstrated that, vis-a-vis the two cycles taught respectively in U.S. Pat. No. 4,439,220 and GB Patent 1,215,337 as discussed earlier, the present invention has the lowest specific power where specific power was calculated as the total power of the cycle divided by total nitrogen production. All three cycles were simulated to give the highest possible amount of gaseous high pressure nitrogen product at 132 psia. Refrigeration in all three cycles was provided by expanding a portion of the air feed directly to the low pressure column as shown in FIG. 12.

The skilled practitioner will appreciate that there are many other embodiments of the present invention which are within the scope of the following claims.

I claim:

1. A process for the cryogenic distillation of an air feed to produce nitrogen using a distillation column system comprising a high pressure column, a low pressure column and an auxiliary low pressure separation zone, said process comprising:

(a) feeding at least a portion of the air feed to the bottom of the high pressure column;

(b) removing a nitrogen-enriched overhead from the top of the high pressure column, collecting a first portion as a high pressure nitrogen product, condensing a second portion in a first reboiler/condenser located in the bottom of the auxiliary low pressure separation zone and feeding at least a first part of the condensed second portion as reflux to an upper location in the high pressure column;

(c) removing a crude liquid oxygen stream from the bottom of the high pressure column, reducing the pressure of at least a first portion of it and feeding said first portion to the top of the auxiliary low pressure separation zone;

(d) removing a crude nitrogen overhead from the top of the auxiliary low pressure separation zone and feeding it directly as a vapor to the low pressure column wherein the auxiliary low pressure separation zone is operated at the same pressure as the low pressure column, plus the expected pressure drop between the auxiliary low pressure separation zone and the low pressure column;

(e) removing one or more oxygen-enriched streams from a lower location in the auxiliary low pressure separation zone in the vapor and/or liquid state and:

(i) feeding any portion thereof directly to the low pressure column; and/or (ii) discarding any vapor portion thereof as a waste stream; and/or (iii) at least partially vaporizing any liquid portion thereof at reduced pressure by indirect heat exchange against a third portion of the nitrogen-enriched overhead from the top of the high pressure column;

(f) removing a nitrogen rich overhead from the top of the low pressure column, collecting at least an initial portion as a low pressure nitrogen product either directly as a vapor and/or as a liquid after condensing it in a second reboiler/condenser located at the top of the low pressure column; and (g) removing a oxygen rich liquid stream from the bottom of the low pressure column.

2. The process of claim 1 wherein:

(i) step (f) further comprises condensing at least the remaining portion of the nitrogen rich overhead from the low pressure column in the second reboiler/condenser located at the top of the low pressure column and feeding at least a first part as reflux to an upper location in the low pressure column; and (ii) step (g) further comprises reducing the pressure of the oxygen rich liquid stream, vaporizing it in the second reboiler/condenser located at the top of the low pressure column and discarding the vaporized stream as a waste stream.

3. The process of claim 2 wherein the entire amount of the nitrogen-enriched overhead which is removed from the top of the high pressure column is condensed by indirect heat exchange against vaporizing oxygen-enriched liquid from the bottom of the auxiliary low pressure separation zone except for the portion which is removed as the high pressure nitrogen product.

4. The process of claim 3 wherein at least one of the one or more oxygen-enriched streams which is removed from the auxiliary low pressure separation zone in step (e) is removed in a state which is at least partially vapor.

5. The process of claim 4 wherein in step (d), the crude nitrogen overhead from the auxiliary low pressure separation zone is more specifically fed to an intermediate location in the low pressure column.

6. The process of claim 5 wherein:

(i) the auxiliary low pressure separation zone further comprises a distillation section located above the first reboiler/condenser; and (ii) step (e) more specifically comprises removing a first oxygen-enriched vapor stream from a location in the auxiliary low pressure separation zone between the distillation section and the first reboiler/condenser, removing a second oxygen-enriched liquid stream from the bottom of the auxiliary low pressure separation zone and feeding the first and second oxygen-enriched streams to the bottom of the low pressure column.

7. The process of claim 5 wherein:

(i) step (e) more specifically comprises removing a single oxygen-enriched vapor stream from an intermediate location in the auxiliary low pressure separation zone and discarding it as a waste stream;

(ii) the auxiliary low pressure separation zone optionally further comprises a distillation section located above the first reboiler/condenser, in which case the single oxygen-enriched vapor stream removed in step (e) is more specifically removed from a location in the auxiliary low pressure separation zone between the distillation section and the first reboiler/condenser; and (iii) step (e) optionally further comprises feeding a second part of the single oxygen-enriched vapor stream to the bottom of the low pressure column.

8. The process of claim 5 wherein:

(i) the auxiliary low pressure separation zone further comprises a distillation section located above the first reboiler/condenser in addition to further comprising a first auxiliary reboiler/condenser;

(ii) step (b) further comprises condensing a third portion of the nitrogen-enriched overhead from the top of the high pressure column in the first auxiliary reboiler/condenser and feeding at least a first part of the condensed third portion as reflux to an upper location in the high pressure column; and (iii) step (e) more specifically comprises removing a first oxygen-enriched stream from a location in the auxiliary low pressure separation zone between the distillation section and the first reboiler/condenser and feeding it to the bottom of the low pressure column, removing a second oxygen-enriched liquid stream from the bottom of the auxiliary low pressure separation zone, reducing its pressure, vaporizing it in the first auxiliary reboiler/condenser and discarding the vaporized stream as a waste stream.

9. The process of claim 5 wherein:

(i) the auxiliary low pressure separation zone further comprises a first distillation section located above the first reboiler/condenser, a second distillation section located below the first reboiler/condenser and a first auxiliary reboiler/condenser located below the second distillation section;

(ii) step (e) more specifically comprises removing a single oxygen-enriched stream from a location in the auxiliary low pressure separation zone between the second distillation section and the first auxiliary reboiler/condenser and feeding it to the bottom of the low pressure column; and (iii) a second portion of the air feed is condensed in the first auxiliary reboiler/condenser and fed as reflux to an intermediate location in the high pressure column.

10. The process of claim 6 wherein:

(i) a portion of the nitrogen-enriched vapor ascending the high pressure column is removed from an intermediate location in the high pressure column as additional high pressure nitrogen product;

(ii) a second part of the condensed second portion of the nitrogen-enriched overhead from the high pressure column is collected as additional high pressure nitrogen product; and (iii) a portion of the oxygen-enriched liquid descending the low pressure column is removed from an intermediate location in the low pressure column and fed to the top of the auxiliary low pressure separation zone.

11. The process of claim 10 wherein:

(iv) in step (f), a second part of the condensed nitrogen rich overhead from the low pressure column is pumped to an elevated pressure and fed to an intermediate location in the high pressure column.

12. The process of claim 10 wherein:

(iv) a portion of the nitrogen-enriched liquid descending the high pressure column is removed from an intermediate location in the high pressure column, reduced in pressure and fed to the top of the low pressure column.

13. The process of claim 11 wherein:

(i) prior to feeding the air feed to the bottom of the high pressure column in step (a), the air feed is compressed, cleaned of undesirable impurities and cooled in a main heat exchanger to a temperature near its dew point;

(ii) prior to cooling the air feed stream in the main heat exchanger, an air expansion stream is removed, further compressed, partially cooled in the main heat exchanger and turbo-expanded and fed to an intermediate location in the low pressure column;

(iii) the high pressure nitrogen product, low pressure nitrogen product and waste stream are warmed in the main heat exchanger;

(iv) prior to warming the low pressure nitrogen product and waste stream in the main heat exchanger, said streams, along with the second part of the condensed nitrogen rich overhead from the low pressure column, are warmed in a first subcooling heat exchanger against the crude liquid oxygen stream from the bottom of the high pressure column;

(v) prior to warming the low pressure nitrogen product and waste stream in the first subcooling heat exchanger, said streams are warmed in a second subcooling heat exchanger, along with the second part of the condensed nitrogen rich overhead from the low pressure column after it is pumped to an elevated pressure, against the oxygen rich liquid stream from the bottom of the low pressure column; and (vi) after being warmed in the main heat exchanger, the low pressure nitrogen product is compressed to an elevated pressure.

14. The process of claim 6 wherein:

(i) the distillation column system further comprises a liquid oxygen producing column containing a third reboiler/condenser in its bottom;

(ii) a hydrocarbon-depleted stream is removed from an intermediate location in the high pressure column, reduced in pressure and fed to the top of the liquid oxygen producing column;

(iii) prior to reducing the pressure of the first portion of the crude liquid oxygen stream from the bottom of the high pressure column and feeding it to the top of the auxiliary low pressure separation zone, said first portion is subcooled in the third reboiler/condenser;

(iv) an overhead stream is removed from the top of the liquid oxygen producing column and combined with the waste stream; and (v) a liquid oxygen product is removed from the bottom of the liquid oxygen producing column.

15. The process of claim 6 wherein:

(i) the distillation column system further comprises a liquid oxygen producing column containing a third reboiler/condenser in its bottom;

(ii) a hydrocarbon-depleted stream is removed from an intermediate location in the high pressure column, reduced in pressure and fed to the top of the liquid oxygen producing column;

(iii) a second portion of the air feed is further compressed, at least partially condensed in the third reboiler/condenser, combined with the first portion of the crude liquid oxygen stream from the bottom of the high pressure column and fed to the top of the auxiliary low pressure separation zone;

(iv) an overhead stream is removed from the top of the liquid oxygen producing column, combined with the crude nitrogen overhead from the top of the auxiliary low pressure separation zone and fed to an intermediate location in the low pressure column; and (v) a liquid oxygen product is removed from the bottom of the liquid oxygen producing column.

16. The process of claim 6 wherein:

(i) the distillation column system further comprises a liquid oxygen producing column containing a third reboiler/condenser in its bottom;

(ii) a hydrocarbon-depleted stream is removed from an intermediate location in the high pressure column, reduced in pressure and fed to the top of the liquid oxygen producing column;

(iii) a second portion of the air feed is further compressed, at least partially condensed in the third reboiler/condenser, combined with the first portion of the crude liquid oxygen stream from the bottom of the high pressure column and fed to the top of the auxiliary low pressure separation zone;

(iv) a hydrocarbon-depleted stream is removed from an upper intermediate location in the low pressure column and combined with the hydrocarbon-depleted stream which is removed from the high pressure column;

(v) an overhead stream is removed from the top of the liquid oxygen producing column and fed to an upper intermediate location in the auxiliary low pressure separation zone; and (vi) a liquid oxygen product is removed from the bottom of the liquid oxygen producing column.

17. The process of claim 1 wherein:

(i) step (f) further comprises condensing at least the remaining portion of the nitrogen rich overhead from the low pressure column in the second reboiler/condenser located at the top of the low pressure column and feeding at least a first part as reflux to an upper location in the low pressure column;

(ii) step (g) further comprises reducing the pressure of the oxygen rich liquid stream, vaporizing it in the second reboiler/condenser located at the top of the low pressure column and discarding the vaporized stream as a waste stream; and (iii) the entire amount of the nitrogen-enriched overhead which is removed from the top of the high pressure column is condensed by indirect heat exchange against vaporizing oxygen-enriched liquid from the bottom of the auxiliary low pressure separation zone except for the portion which is removed as the high pressure nitrogen product.

18. The process of claim 17 wherein:

(i) the auxiliary low pressure separation zone further comprises a first auxiliary reboiler/condenser;

(ii) step (b) further comprises condensing a third portion of the nitrogen-enriched overhead from the top of the high pressure column in the first auxiliary reboiler/condenser and feeding at least a first part of the condensed third portion as reflux to an upper location in the high pressure column;

(iii) in step (d), the crude nitrogen overhead from the auxiliary low pressure separation zone is more specifically fed to the bottom of the low pressure column; and (iv) step (e) more specifically comprises removing a single oxygen-enriched liquid stream from the bottom of the auxiliary low pressure separation zone, reducing its pressure, partially vaporizing it in the first auxiliary reboiler condenser, discarding the vaporized stream as a waste stream, reducing the pressure of the remaining liquid portion and combining the remaining liquid portion with the oxygen rich liquid stream from the bottom of the low pressure column.

19. The process of claim 1 wherein:

(i) at least one of the one or more oxygen-enriched streams which is removed from the auxiliary low pressure separation zone in step (e) is removed in a state which is at least partially vapor; and (ii) in step (d), the crude nitrogen overhead from the auxiliary low pressure separation zone is more specifically fed to an intermediate location in the low pressure column.

20. The process of claim 19 wherein:

(i) the auxiliary low pressure separation zone further comprises a distillation section located above the first reboiler/condenser;

(ii) step (b) further comprises condensing a third portion of the nitrogen-enriched overhead from the top of the high pressure column in a second auxiliary reboiler/condenser, feeding a first part of the condensed third portion as reflux to an upper location in the high pressure column, reducing the pressure of a second part and feeding the second part as reflux to an upper location in the low pressure column;

(iii) step (e) more specifically comprises removing a first oxygen-enriched stream from a location in the auxiliary low pressure separation zone between the distillation section and the first reboiler/condenser and feeding it to the bottom of the low pressure column; and (iv) step (g) further comprises reducing the pressure of the oxygen rich liquid stream, vaporizing it in the second auxiliary reboiler/condenser and discarding the vaporized stream as a waste stream.

* * * * *